US009479860B2

(12) United States Patent
Kwatra et al.

(10) Patent No.: US 9,479,860 B2
(45) Date of Patent: Oct. 25, 2016

(54) SYSTEMS AND METHODS FOR ENHANCING PERFORMANCE OF AUDIO TRANSDUCER BASED ON DETECTION OF TRANSDUCER STATUS

(71) Applicant: Cirrus Logic, Inc., Austin, TX (US)

(72) Inventors: Nitin Kwatra, Austin, TX (US); John L. Melanson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 103 days.

(21) Appl. No.: 14/200,458

(22) Filed: Mar. 7, 2014

(65) Prior Publication Data

US 2015/0256953 A1 Sep. 10, 2015

(51) Int. Cl.
*H04R 29/00* (2006.01)
*H04R 1/10* (2006.01)
*H04R 5/04* (2006.01)

(52) U.S. Cl.
CPC ..... *H04R 1/1083* (2013.01); *H04R 5/04* (2013.01); *H04R 2410/05* (2013.01); *H04R 2460/01* (2013.01); *H04R 2499/11* (2013.01)

(58) Field of Classification Search
CPC ..... H04R 29/00; H04R 1/10; H04R 3/002; H04R 1/1083; H04R 2499/04; H04R 5/04; H04R 2460/01; H04R 2410/05
USPC ..... 381/74, 58
See application file for complete search history.

(56) References Cited

U.S. PATENT DOCUMENTS 5,251,263 A 10/1993 Andrea et al.
5,278,913 A 1/1994 Delfosse et al.
5,321,759 A 6/1994 Yuan
5,337,365 A 8/1994 Hamabe et al.
5,359,662 A 10/1994 Yuan et al.
5,410,605 A 4/1995 Sawada et al.
5,425,105 A 6/1995 Lo et al.
5,445,517 A 8/1995 Kondou et al.
5,465,413 A 11/1995 Enge et al.

(Continued)

FOREIGN PATENT DOCUMENTS

CN 105284126 A 1/2016
CN 105308678 A 2/2016

(Continued)

OTHER PUBLICATIONS

Kou, Sen and Tsai, Jianming, Residual noise shaping technique for active noise control systems, J. Acoust. Soc. Am. 95 (3), Mar. 1994, pp. 1665-1668.

(Continued)

*Primary Examiner* — Vivian Chin
*Assistant Examiner* — Ammar Hamid
(74) *Attorney, Agent, or Firm* — Jackson Walker L.L.P.

(57) ABSTRACT

Based on transducer status input signals indicative of whether headphones housing respective transducers are engaged with ears of a listener, a processing circuit may determine whether the headphones are engaged with respective ears of the listener. Responsive to determining that at least one of the headphones is not engaged with its respective ear, the processing circuit may modify at least one of a first output signal to the first transducer and a second output signal to the second transducer such that at least one of the first output signal and the second output signal is different than such signal would be if the headphones were engaged with their respective ears.

28 Claims, 6 Drawing Sheets

(56) References Cited

U.S. PATENT DOCUMENTS 5,481,615 A 1/1996 Eatwell et al.
5,548,681 A 8/1996 Gleaves et al.
5,559,893 A 9/1996 Krokstad
5,586,190 A 12/1996 Trantow et al.
5,640,450 A 6/1997 Watanabe
5,668,747 A 9/1997 Ohashi
5,696,831 A * 12/1997 Inanaga ..... H04S 1/007 381/309
5,699,437 A 12/1997 Finn
5,706,344 A 1/1998 Finn
5,740,256 A 4/1998 Castello Da Costa et al.
5,768,124 A 6/1998 Stothers et al.
5,815,582 A 9/1998 Claybaugh et al.
5,832,095 A 11/1998 Daniels
5,909,498 A 6/1999 Smith
5,940,519 A 8/1999 Kuo
5,946,391 A 8/1999 Dragwidge et al.
5,991,418 A 11/1999 Kuo
6,041,126 A 3/2000 Terai et al.
6,118,878 A 9/2000 Jones
6,219,427 B1 4/2001 Kates et al.
6,278,786 B1 8/2001 McIntosh
6,282,176 B1 8/2001 Hemkumar
6,418,228 B1 7/2002 Terai et al.
6,434,246 B1 8/2002 Kates et al.
6,434,247 B1 8/2002 Kates et al.
6,522,746 B1 2/2003 Marchok et al.
6,683,960 B1 1/2004 Fujii et al.
6,766,292 B1 7/2004 Chandran et al.
6,768,795 B2 7/2004 Feltstrom et al.
6,850,617 B1 2/2005 Weigand
6,940,982 B1 9/2005 Watkins
7,058,463 B1 6/2006 Ruha et al.
7,103,188 B1 9/2006 Jones
7,181,030 B2 2/2007 Rasmussen et al.
7,330,739 B2 2/2008 Somayajula
7,365,669 B1 4/2008 Melanson
7,466,838 B1 12/2008 Moseley
7,680,456 B2 3/2010 Muhammad et al.
7,742,790 B2 6/2010 Konchitsky et al.
7,817,808 B2 10/2010 Konchitsky et al.
7,885,417 B2 2/2011 Christoph
8,019,050 B2 9/2011 Mactavish et al.
8,249,262 B2 8/2012 Chua et al.
8,290,537 B2 10/2012 Lee et al.
8,325,934 B2 12/2012 Kuo
8,363,856 B2 1/2013 Lesso et al.
8,379,884 B2 2/2013 Horibe et al.
8,401,200 B2 3/2013 Tiscareno et al.
8,442,251 B2 5/2013 Jensen et al.
8,526,627 B2 9/2013 Asao et al.
8,804,974 B1 8/2014 Melanson
8,848,936 B2 9/2014 Kwatra et al.
8,907,829 B1 12/2014 Naderi
8,908,877 B2 12/2014 Abdollahzadeh Milani et al.
8,948,407 B2 2/2015 Alderson et al.
8,958,571 B2 2/2015 Kwatra et al.
9,066,176 B2 6/2015 Hendrix et al.
9,094,744 B1 7/2015 Lu et al.
9,106,989 B2 8/2015 Li et al.
9,107,010 B2 8/2015 Abdollahzadeh Milani et al.
9,264,808 B2 2/2016 Zhou et al.
9,294,836 B2 3/2016 Zhou et al.
2001/0053228 A1 12/2001 Jones
2002/0003887 A1 1/2002 Zhang et al.
2003/0063759 A1 4/2003 Brennan et al.
2003/0072439 A1 4/2003 Gupta
2003/0185403 A1 10/2003 Sibbald
2004/0001450 A1 1/2004 He et al.
2004/0047464 A1 3/2004 Yu et al.
2004/0120535 A1 6/2004 Woods
2004/0165736 A1 8/2004 Hetherington et al.
2004/0167777 A1 8/2004 Hetherington et al.
2004/0176955 A1 9/2004 Farinelli, Jr. et al.
2004/0196992 A1 10/2004 Ryan
2004/0202333 A1 10/2004 Csermak et al.
2004/0240677 A1 12/2004 Onishi et al.
2004/0242160 A1 12/2004 Ichikawa et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0035593 A1 2/2006 Leeds
2006/0055910 A1 3/2006 Lee
2006/0069556 A1 3/2006 Nadjar et al.
2006/0109941 A1 5/2006 Keele, Jr.
2006/0153400 A1 7/2006 Fujita et al.
2007/0030989 A1 2/2007 Kates
2007/0033029 A1 2/2007 Sakawaki
2007/0038441 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0107281 A1 5/2008 Togami et al.
2008/0144853 A1 6/2008 Sommerfeldt et al.
2008/0166002 A1 7/2008 Amsel
2008/0177532 A1 7/2008 Greiss et al.
2008/0181422 A1 7/2008 Christoph
2008/0226098 A1 9/2008 Haulick et al.
2008/0240413 A1 10/2008 Mohammed et al.
2008/0240455 A1 10/2008 Inoue et al.
2008/0240457 A1 10/2008 Inoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.
2010/0124336 A1 5/2010 Shridhar et al.
2010/0124337 A1 5/2010 Wertz et al.
2010/0131269 A1 5/2010 Park et al.
2010/0142715 A1 6/2010 Goldstein et al.
2010/0150367 A1 6/2010 Mizuno
2010/0158330 A1 6/2010 Guissin et al.
2010/0166203 A1 7/2010 Peissig et al.
2010/0183175 A1 7/2010 Chen et al.
2010/0195838 A1 8/2010 Bright
2010/0195844 A1 8/2010 Christoph et al.
2010/0207317 A1 8/2010 Iwami et al.
2010/0246855 A1 9/2010 Chen
2010/0266137 A1 10/2010 Sibbald et al.
2010/0272276 A1 10/2010 Carreras et al.
2010/0272283 A1 10/2010 Carreras et al.
2010/0272284 A1 10/2010 Joho et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.

(56) References Cited

U.S. PATENT DOCUMENTS

2010/0310086 A1 12/2010 Magrath et al.
2010/0310087 A1 12/2010 Ishida
2010/0316225 A1 12/2010 Saito et al.
2010/0322430 A1 12/2010 Isberg
2011/0002468 A1 1/2011 Tanghe
2011/0007907 A1 1/2011 Park et al.
2011/0026724 A1 2/2011 Doclo
2011/0096933 A1 4/2011 Eastty
2011/0106533 A1 5/2011 Yu
2011/0116643 A1 5/2011 Tiscareno
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0150257 A1 6/2011 Jensen
2011/0158419 A1 6/2011 Theverapperuma et al.
2011/0206214 A1 8/2011 Christoph et al.
2011/0222698 A1 9/2011 Asao et al.
2011/0222701 A1* 9/2011 Donaldson ..... H04R 1/1083 381/74
2011/0249826 A1 10/2011 Van Leest
2011/0288860 A1 11/2011 Schevciw et al.
2011/0293103 A1 12/2011 Park et al.
2011/0299695 A1 12/2011 Nicholson
2011/0305347 A1 12/2011 Wurm
2011/0317848 A1 12/2011 Ivanov et al.
2012/0057720 A1 3/2012 Van Leest
2012/0084080 A1 4/2012 Konchitsky et al.
2012/0135787 A1 5/2012 Kusunoki et al.
2012/0140917 A1 6/2012 Nicholson et al.
2012/0140942 A1 6/2012 Loeda
2012/0140943 A1 6/2012 Hendrix et al.
2012/0148062 A1 6/2012 Scarlett et al.
2012/0155666 A1 6/2012 Nair
2012/0170766 A1 7/2012 Alves et al.
2012/0185524 A1 7/2012 Clark
2012/0207317 A1* 8/2012 Abdollahzadeh Milani ..... G10K 11/1784 381/71.6
2012/0215519 A1 8/2012 Park et al.
2012/0250873 A1 10/2012 Bakalos et al.
2012/0259626 A1 10/2012 Li et al.
2012/0263317 A1 10/2012 Shin et al.
2012/0281850 A1 11/2012 Hyatt
2012/0300958 A1 11/2012 Klemmensen
2012/0300960 A1 11/2012 Mackay et al.
2012/0308021 A1 12/2012 Kwatra et al.
2012/0308024 A1 12/2012 Alderson et al.
2012/0308025 A1 12/2012 Hendrix et al.
2012/0308026 A1 12/2012 Kamath et al.
2012/0308027 A1 12/2012 Kwatra
2012/0308028 A1 12/2012 Kwatra et al.
2012/0310640 A1 12/2012 Kwatra et al.
2012/0316872 A1 12/2012 Stoltz et al.
2013/0010982 A1 1/2013 Elko et al.
2013/0083939 A1 4/2013 Fellers et al.
2013/0156238 A1 6/2013 Birch et al.
2013/0222516 A1 8/2013 Do et al.
2013/0243198 A1 9/2013 Van Rumpt
2013/0243225 A1 9/2013 Yokota
2013/0259251 A1 10/2013 Bakalos
2013/0272539 A1 10/2013 Kim et al.
2013/0287218 A1 10/2013 Alderson et al.
2013/0287219 A1 10/2013 Hendrix et al.
2013/0301842 A1 11/2013 Hendrix et al.
2013/0301846 A1 11/2013 Alderson et al.
2013/0301847 A1 11/2013 Alderson et al.
2013/0301848 A1 11/2013 Zhou et al.
2013/0301849 A1 11/2013 Alderson
2013/0315403 A1 11/2013 Samuelsson
2013/0343556 A1 12/2013 Bright
2013/0343571 A1 12/2013 Rayala et al.
2014/0036127 A1 2/2014 Pong et al.
2014/0044275 A1 2/2014 Goldstein et al.
2014/0050332 A1 2/2014 Nielsen et al.
2014/0051483 A1 2/2014 Schoerkmaier
2014/0072134 A1 3/2014 Po et al.
2014/0072135 A1 3/2014 Bajic et al.
2014/0086425 A1 3/2014 Jensen et al.
2014/0126735 A1 5/2014 Gauger, Jr.
2014/0169579 A1 6/2014 Azmi
2014/0177851 A1 6/2014 Kitazawa et al.
2014/0177890 A1 6/2014 Hojlund et al.
2014/0211953 A1 7/2014 Alderson et al.
2014/0226827 A1 8/2014 Abdollahzadeh Milani et al.
2014/0270222 A1 9/2014 Hendrix et al.
2014/0270223 A1 9/2014 Li et al.
2014/0270224 A1 9/2014 Zhou et al.
2014/0294182 A1 10/2014 Axelsson
2014/0307887 A1 10/2014 Alderson et al.
2014/0307888 A1 10/2014 Alderson et al.
2014/0307890 A1 10/2014 Zhou et al.
2014/0307899 A1 10/2014 Hendrix et al.
2014/0314244 A1 10/2014 Yong et al.
2014/0314246 A1 10/2014 Hellman
2014/0314247 A1* 10/2014 Zhang ..... H04R 1/1041 381/74
2014/0341388 A1 11/2014 Goldstein
2014/0369517 A1 12/2014 Zhou et al.
2015/0078572 A1 3/2015 Milani et al.
2015/0092953 A1 4/2015 Abdollahzadeh Milani et al.
2015/0104032 A1 4/2015 Kwatra et al.
2015/0161980 A1 6/2015 Alderson et al.
2015/0161981 A1 6/2015 Kwatra
2015/0163592 A1 6/2015 Alderson
2015/0256660 A1 9/2015 Kaller et al.
2015/0256953 A1 9/2015 Kwatra et al.
2015/0269926 A1 9/2015 Alderson et al.
2015/0365761 A1 12/2015 Alderson

FOREIGN PATENT DOCUMENTS

CN 105324810 A 2/2016
CN 105453170 A 3/2016
CN 105453587 A 3/2016
DE 102011013343 A1 9/2012
EP 0412902 A2 2/1991
EP 0756407 A2 1/1997
EP 1691577 A2 8/2006
EP 1880699 A2 1/2008
EP 1947642 A1 7/2008
EP 2133866 A1 12/2009
EP 2237573 A1 10/2010
EP 2216774 A1 8/2011
EP 2395500 A1 12/2011
EP 2395501 A1 12/2011
EP 2551845 A1 1/2013
EP 2583074 A1 4/2013
EP 2984648 A2 2/2016
EP 2987160 A1 2/2016
EP 2987162 A1 2/2016
EP 2987337 A1 2/2016
GB 2401744 A 11/2004
GB 2436657 A 10/2007
GB 2455821 A 6/2009
GB 2455824 A 6/2009
GB 2455828 A 6/2009
GB 2484722 A 4/2012
JP H06186985 A 7/1994
JP H06232755 8/1994
JP 07325588 A 12/1995
JP 2000089770 3/2000
JP 2004007107 1/2004
JP 2006217542 A 8/2006
JP 2007060644 3/2007
JP 2010277025 12/2010
JP 2011061449 3/2011
WO 9911045 3/1999
WO 03015074 A1 2/2003
WO 03015275 A1 2/2003
WO WO2004009007 A1 1/2004
WO 2004017303 A1 2/2004
WO 2006128768 A1 12/2006
WO 2007007916 A1 1/2007

(56) References Cited

FOREIGN PATENT DOCUMENTS

| | | | |
|---|---|---|---|
| WO | 2007011337 | A1 | 1/2007 |
| WO | 2007110807 | A2 | 10/2007 |
| WO | 2007113487 | A1 | 11/2007 |
| WO | 2009041012 | A1 | 4/2009 |
| WO | 2009110087 | A1 | 9/2009 |
| WO | 2010117714 | A1 | 10/2010 |
| WO | 2011035061 | A1 | 3/2011 |
| WO | 2012119808 | A2 | 9/2012 |
| WO | 2012134874 | A1 | 10/2012 |
| WO | 2012166273 | A2 | 12/2012 |
| WO | 2012166388 | A2 | 12/2012 |
| WO | 2014158475 | A1 | 10/2014 |
| WO | 2014168685 | A2 | 10/2014 |
| WO | 2014172005 | A1 | 10/2014 |
| WO | 2014172006 | A1 | 10/2014 |
| WO | 2014172010 | A1 | 10/2014 |
| WO | 2014172019 | A1 | 10/2014 |
| WO | 2014172021 | A1 | 10/2014 |
| WO | 2014200787 | A1 | 12/2014 |
| WO | 2015038255 | A1 | 3/2015 |
| WO | 2015088639 | A | 6/2015 |
| WO | 2015088651 | A1 | 6/2015 |
| WO | 2015088653 | A1 | 6/2015 |
| WO | 2015/134225 | A1 | 9/2015 |
| WO | 2015191691 | A1 | 12/2015 |

OTHER PUBLICATIONS

Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.

Toochinda, et al., "A Single-Input Two-Output Feedback Formulation for ANC Problems," Proceedings of the 2001 American Control Conference, Jun. 2001, pp. 923-928, vol. 2, Arlington, VA.

Kuo, et al., "Active Noise Control: A Tutorial Review," Proceedings of the IEEE, Jun. 1999, pp. 943-973, vol. 87, No. 6, IEEE Press, Piscataway, NJ.

Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.

Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.

Mali, Dilip, "Comparison of DC Offset Effects on LMB Algorithm and its Derivatives," International Journal of Recent Trends in Engineering, May 2009, pp. 323-328, vol. 1, No. 1, Academy Publisher.

Kates, James M., "Principles of Digital Dynamic Range Compression," Trends in Amplification, Spring 2005, pp. 45-76, vol. 9, No. 2, Sage Publications.

Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.

Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.

Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.

Davari, et al., "A New Online Secondary Path Modeling Method for Feedforward Active Noise Control Systems," IEEE International Conference on Industrial Technology, Apr. 21-24, 2008, pp. 1-6, Chengdu, China.

Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.

Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.

Booji, P.S., Berkhoff, A.P., Virtual sensors for local, three dimensional, broadband multiple-channel active noise control and the effects on the quiet zones, Proceedings of ISMA2010 including USD2010, pp. 151-166.

Lopez-Caudana, Edgar Omar, Active Noise Cancellation: The Unwanted Signal and The Hybrid Solution, Adaptive Filtering Applications, Dr. Lino Garcia, ISBN: 978-953-307-306-4, InTech.

D. Senderowicz et al., "Low-Voltage Double-Sampled Delta-Sigma Converters," IEEE J. Solid-State Circuits, vol. 32 No. 12, pp. 1907-1919, Dec. 1997, 13 pages.

Hurst, P.J. and Dyer, K.C., "An improved double sampling scheme for switched-capacitor delta-sigma modulators," IEEE Int. Symp. Circuits Systems, May 1992, vol. 3, pp. 1179-1182, 4 pages.

Milani, et al., "On Maximum Achievable Noise Reduction in ANC Systems", Proceedings of the IEEE International Conference on Acoustics, Speech, and Signal Processing, ICASSP 2010, Mar. 14-19, 2010 pp. 349-352.

Ryan, et al., "Optimum near-field performance of microphone arrays subject to a far-field beampattern constraint", 2248 J. Acoust. Soc. Am. 108, Nov. 2000.

Cohen, et al., "Noise Estimation by Minima Controlled Recursive Averaging for Robust Speech Enhancement", IEEE Signal Processing Letters, vol. 9, No. 1, Jan. 2002.

Martin, "Noise Power Spectral Density Estimation Based on Optimal Smoothing and Minimum Statistics", IEEE Trans. on Speech and Audio Processing, col. 9, No. 5, Jul. 2001.

Martin, "Spectral Subtraction Based on Minimum Statistics", Proc. 7th EUSIPCO '94, Edinburgh, U.K., Sep. 13-16, 1994, pp. 1182-1195.

Cohen, "Noise Spectrum Estimation in Adverse Environments: Improved Minima Controlled Recursive Averaging", IEEE Trans. on Speech & Audio Proc., vol. 11, Issue 5, Sep. 2003.

Black, John W., "An Application of Side-Tone in Subjective Tests of Microphones and Headsets", Project Report No. NM 001 064. 01.20, Research Report of the U.S. Naval School of Aviation Medicine, Feb. 1, 1954, 12 pages (pp. 1-12 in pdf), Pensacola, FL, US.

Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.

Liu, et al., "Compensatory Responses to Loudness-shifted Voice Feedback During Production of Mandarin Speech", Journal of the Acoustical Society of America, Oct. 2007, pp. 2405-2412, vol. 122, No. 4.

Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.

Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.

Therrien, et al., "Sensory Attenuation of Self-Produced Feedback: The Lombard Effect Revisited", PLoS One, Nov. 2012, pp. 1-7, vol. 7, Issue 11, e49370, Ontario, Canada.

Jin, et al., "A simultaneous equation method-based online secondary path modeling algorithm for active noise control", Journal of Sound and Vibration, Apr. 25, 2007, pp. 455-474, vol. 303, No. 3-5, London, GB.

Erkelens et al., "Tracking of Nonstationary Noise Based on Data-Driven Recursive Noise Power Estimation", IEEE Transactions on Audio Speech, and Language Processing, vol. 16, No. 6, Aug. 2008.

Rao et al., "A Novel Two Stage Single Channle Speech Enhancement Technique", India Conference (IndiCon) 2011 Annual IEEE, IEEE, Dec. 15, 2011.

(56) References Cited

OTHER PUBLICATIONS

Rangachari et al., "A noise-estimation algorithm for highly non-stationary environments" Speech Communication, Elsevier Science Publishers, vol. 48, No. 2, Feb. 1, 2006.
International Search Report and Written Opinion of the International Searching Authority, International Patent Application No. PCT/US2014/017343, mailed Aug. 8, 2014, 22 pages.
International Search Report and Written Opinion of the International Searching Authority, International Patent Application No. PCT/US2014/018027, mailed Sep. 4, 2014, 14 pages.
International Search Report and Written Opinion of the International Searching Authority, International Patent Application No. PCT/US2014/017374, mailed Sep. 8, 2014, 13 pages.
International Search Report and Written Opinion of the International Searching Authority, International Patent Application No. PCT/US2014/019395, mailed Sep. 9, 2014, 14 pages.
International Search Report and Written Opinion of the International Searching Authority, International Patent Application No. PCT/US2014/019469, mailed Sep. 12, 2014, 13 pages.
Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.
Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.
Widrow, B. et al., Adaptive Noise Cancelling: Principles and Applications, Proceedings of the IEEE, IEEE, New York, NY, U.S., vol. 63, No. 13, Dec. 1975, pp. 1692-1716.
Morgan, Dennis R. et al., A Delayless Subband Adaptive Filter Architecture, IEEE Transactions on Signal Processing, IEEE Service Center, New York, NY, U.S., vol. 43, No. 8, Aug. 1995, pp. 1819-1829.
International Patent Application No. PCT/US2014/040999, International Search Report and Written Opinion, Oct. 18, 2014, 12 pages.
International Patent Application No. PCT/US2013/049407, International Search Report and Written Opinion, Jun. 18, 2014, 13 pages.
Ray, Laura et al., Hybrid Feedforward-Feedback Active Noise Reduction for Hearing Protection and Communication, The Journal of the Acoustical Society of America, American Institute of Physics for the Acoustical Society of America, New York, NY, vol. 120, No. 4, Jan. 2006, pp. 2026-2036.
International Patent Application No. PCT/US2014/017112, International Search Report and Written Opinion, May 8, 2015, 22 pages.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
International Patent Application No. PCT/US2014/017096, International Search Report and Written Opinion, May 27, 2014, 11 pages.
International Patent Application No. PCT/US2014/049600, International Search Report and Written Opinion, Jan. 14, 2015, 12 pages.
International Patent Application No. PCT/US2014/061753, International Search Report and Written Opinion, Feb. 9, 2015, 8 pages.
International Patent Application No. PCT/US2014/061548, International Search Report and Written Opinion, Feb. 12, 2015, 13 pages.
International Patent Application No. PCT/US2014/060277, International Search Report and Written Opinion, Mar. 9, 2015, 11 pages.
International Patent Application No. PCT/US2015/017124, International Search Report and Written Opinion, Jul. 13, 2015, 19 pages.
International Patent Application No. PCT/US2015/035073, International Search Report and Written Opinion, Oct. 8, 2015, 11 pages.
Parkins, et al., Narrowband and broadband active control in an enclosure using the acoustic energy density, J. Acoust. Soc. Am. Jul. 2000, pp. 192-203, vol. 108, issue 1, U.S.
International Patent Application No. PCT/US2015/022113, International Search Report and Written Opinion, Jul. 23, 2015, 13 pages.
Combined Search and Examination Report, Application No. GB1512832.5, mailed Jan. 28, 2016, 7 pages.
International Patent Application No. PCT/US2015/066260, International Search Report and Written Opinion, Apr. 21, 2016, 13 pages.
English machine translation of JP 2006-217542 A (Okumura, Hiroshi; Howling Suppression Device and Loudspeaker, published Aug. 2006).
Combined Search and Examination Report, Application No. GB1519000.2, mailed Apr. 21, 2016, 5 pages.

* cited by examiner

SYSTEMS AND METHODS FOR ENHANCING PERFORMANCE OF AUDIO TRANSDUCER BASED ON DETECTION OF TRANSDUCER STATUS

FIELD OF DISCLOSURE

The present disclosure relates in general to personal audio devices, and more particularly, to enhancing performance of an audio transducer based on detection of a transducer status.

BACKGROUND

Wireless telephones, such as mobile/cellular telephones, cordless telephones, and other consumer audio devices, such as mp3 players, are in widespread use. Often, such personal audio devices are capable of outputting two channels of audio, each channel to a respective transducer, wherein the transducers may be housed in a respective headphone adapted to engage with a listener's ear. In existing personal audio devices, processing and communication of audio signals to each of the transducers often assumes that each headphone is engaged with respective ears of the same listener. However, such assumptions may not be desirable in situations in which at least one of the headphones is not engaged with an ear of the listener (e.g., one headphone is engaged with an ear of a listener and another is not, both headphones are not engaged with the ears of any listeners, headphones are simultaneously engaged with ears of two different listeners, etc.).

SUMMARY

In accordance with the teachings of the present disclosure, the disadvantages and problems associated with improving audio performance of a personal audio device may be reduced or eliminated.

In accordance with embodiments of the present disclosure, an integrated circuit for implementing at least a portion of a personal audio device may include a first output, a second output, a first transducer status signal input, a second transducer status signal input, and a processing circuit. The first output may be configured to provide a first output signal to a first transducer. The second output may be configured to provide a second output signal to a second transducer. The first transducer status signal input may be configured to receive a first transducer status input signal indicative of whether a first headphone housing the first transducer is engaged with a first ear of a listener. A second transducer status signal input may be configured to receive a second transducer status input signal indicative of whether a second headphone housing the second transducer is engaged with a second ear of the listener. The processing circuit may be configured to, based at least on the first transducer status input signal and the second transducer status input signal, determine whether the first headphone is engaged with the first ear and the second headphone is engaged with the second ear. The processing circuit may further be configured to, responsive to determining that at least one of the first headphone is not engaged with the first ear and the second headphone is not engaged with the second ear, modify at least one of the first output signal and the second output signal such that at least one of the first output signal and the second output signal is different than such signal would be if the first headphone was engaged with the first ear and the second headphone was engaged with the second ear.

In accordance with these and other embodiments of the present disclosure, a method may include, based at least on a first transducer status input signal indicative of whether a first headphone housing a first transducer is engaged with a first ear of a listener and a second transducer status input signal indicative of whether a second headphone housing a second transducer is engaged with a second ear of the listener, determining whether the first headphone is engaged with the first ear and the second headphone is engaged with the second ear. The method may further include, responsive to determining that at least one of the first headphone is not engaged with the first ear and the second headphone is not engaged with the second ear, modifying at least one of a first output signal to the first transducer and a second output signal to the second transducer such that at least one of the first output signal and the second output signal is different than such signal would be if the first headphone was engaged with the first ear and the second headphone was engaged with the second ear.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1A:
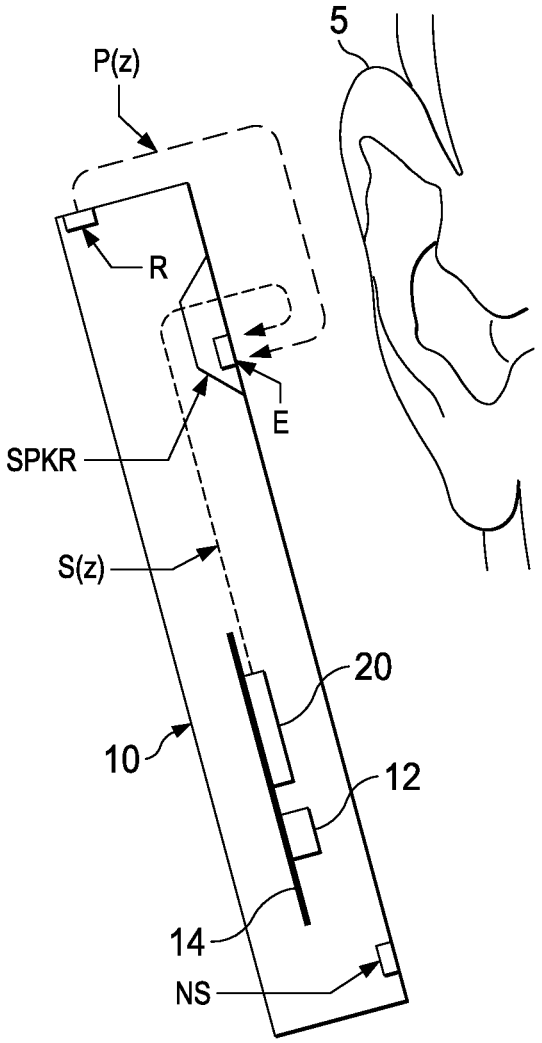
FIG. 1A is an illustration of an example personal audio device, in accordance with embodiments of the present disclosure.

Referring now to FIG. 1A, a personal audio device 10 as illustrated in accordance with embodiments of the present disclosure is shown in proximity to a human ear 5. Personal audio device 10 is an example of a device in which techniques in accordance with embodiments of the invention may be employed, but it is understood that not all of the elements or configurations embodied in illustrated personal audio device 10, or in the circuits depicted in subsequent illustrations, are required in order to practice the invention recited in the claims. Personal audio device 10 may include a transducer such as speaker SPKR that reproduces distant speech received by personal audio device 10, along with other local audio events such as ringtones, stored audio program material, injection of near-end speech (i.e., the speech of the listener of personal audio device 10) to provide a balanced conversational perception, and other audio that requires reproduction by personal audio device 10, such as sources from webpages or other network communications received by personal audio device 10 and audio indications such as a low battery indication and other system event notifications. A near-speech microphone NS may be provided to capture near-end speech, which is transmitted from personal audio device 10 to the other conversation participant(s).

Personal audio device 10 may include adaptive noise cancellation (ANC) circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a listener's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when personal audio device 10 is in close proximity to ear 5. Circuit 14 within personal audio device 10 may include an audio CODEC integrated circuit (IC) 20 that receives the signals from reference microphone R, near-speech microphone NS, and error microphone E, and interfaces with other integrated circuits such as a radio-frequency (RF) integrated circuit 12 having a personal audio device transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure measure ambient acoustic events (as opposed to the output of speaker SPKR and/or the near-end speech) impinging on reference microphone R, and by also measuring the same ambient acoustic events impinging on error microphone E, ANC processing circuits of personal audio device 10 adapt an anti-noise signal generated out of the output of speaker SPKR from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to personal audio device 10, when personal audio device 10 is not firmly pressed to ear 5. While the illustrated personal audio device 10 includes a two-microphone ANC system with a third near-speech microphone NS, some aspects of the present invention may be practiced in a system that does not include separate error and reference microphones, or a personal audio device that uses near-speech microphone NS to perform the function of the reference microphone R. Also, in personal audio devices designed only for audio playback, near-speech microphone NS will generally not be included, and the near-speech signal paths in the circuits described in further detail below may be omitted, without changing the scope of the disclosure, other than to limit the options provided for input to the microphone covering detection schemes. In addition, although only one reference microphone R is depicted in FIG. 1, the circuits and techniques herein disclosed may be adapted, without changing the scope of the disclosure, to personal audio devices including a plurality of reference microphones.

Figure 1B:
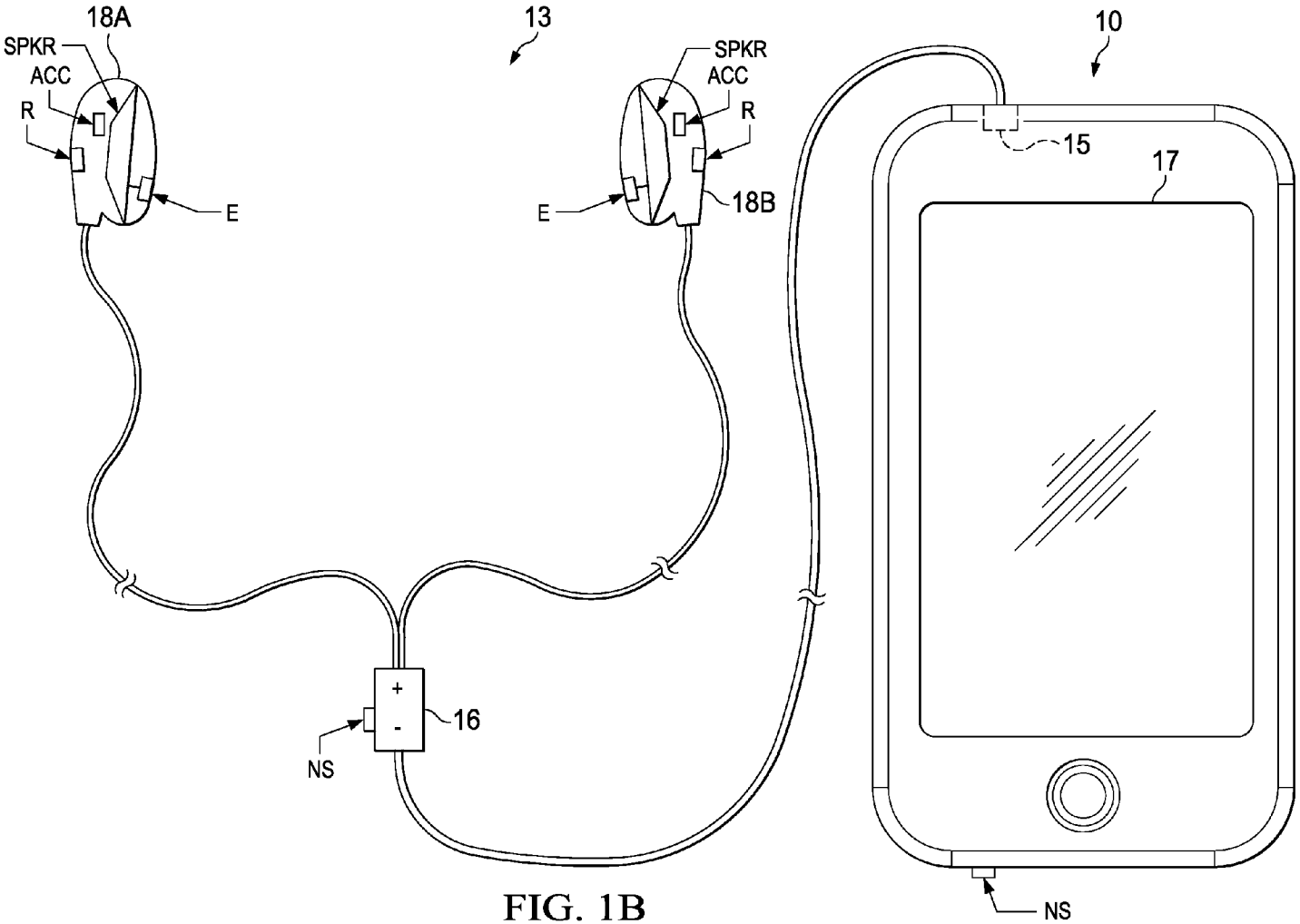
FIG. 1B is an illustration of an example personal audio device with a headphone assembly coupled thereto, in accordance with embodiments of the present disclosure.

Referring now to FIG. 1B, personal audio device 10 is depicted having a headphone assembly 13 coupled to it via audio port 15. Audio port 15 may be communicatively coupled to RF IC 12 and/or CODEC IC 20, thus permitting communication between components of headphone assembly 13 and one or more of RF IC 12 and/or CODEC IC 20. As shown in FIG. 1B, headphone assembly 13 may include a combox 16, a left headphone 18A, and a right headphone 18B (which collectively may be referred to as "headphones 18" and individually as a "headphone 18"). As used in this disclosure, the term "headphone" broadly includes any loudspeaker and structure associated therewith that is intended to be held in place proximate to a listener's ear or ear canal, and includes without limitation earphones, earbuds, and other similar devices. As more specific non-limiting examples, "headphone" may refer to intra-canal earphones, intra-concha earphones, supra-concha earphones, and supra-aural earphones.

Combox 16 or another portion of headphone assembly 13 may have a near-speech microphone NS to capture near-end speech in addition to or in lieu of near-speech microphone NS of personal audio device 10. In addition, each headphone 18A, 18B may include a transducer such as speaker SPKR that reproduces distant speech received by personal audio device 10, along with other local audio events such as ringtones, stored audio program material, injection of near-end speech (i.e., the speech of the listener of personal audio device 10) to provide a balanced conversational perception, and other audio that requires reproduction by personal audio device 10, such as sources from webpages or other network communications received by personal audio device 10 and audio indications such as a low battery indication and other system event notifications. Each headphone 18A, 18B may include a reference microphone R for measuring the ambient acoustic environment and an error microphone E for measuring of the ambient audio combined with the audio reproduced by speaker SPKR close to a listener's ear when such headphone 18A, 18B is engaged with the listener's ear. In some embodiments, CODEC IC 20 may receive the signals from reference microphone R, near-speech microphone NS, and error microphone E of each headphone and perform adaptive noise cancellation for each headphone as described herein. In other embodiments, a CODEC IC or another circuit may be present within headphone assembly 13, communicatively coupled to reference microphone R, near-speech microphone NS, and error microphone E, and configured to perform adaptive noise cancellation as described herein.

As depicted in FIG. 1B, each headphone 18 may include an accelerometer ACC. An accelerometer ACC may include any system, device, or apparatus configured to measure acceleration (e.g., proper acceleration) experienced by its respective headphone. Based on the measured acceleration, an orientation of the headphone relative to the earth may be determined (e.g., by a processor of personal audio device 10 coupled to such accelerometer ACC).

As shown in FIG. 1B, personal audio device 10 may provide a display to a user and receive user input using a touch screen 17, or alternatively, a standard LCD may be combined with various buttons, sliders, and/or dials disposed on the face and/or sides of personal audio device 10.

The various microphones referenced in this disclosure, including reference microphones, error microphones, and near-speech microphones, may comprise any system, device, or apparatus configured to convert sound incident at such microphone to an electrical signal that may be processed by a controller, and may include without limitation an electrostatic microphone, a condenser microphone, an electret microphone, an analog microelectromechanical systems (MEMS) microphone, a digital MEMS microphone, a piezoelectric microphone, a piezo-ceramic microphone, or dynamic microphone.

Figure 2:
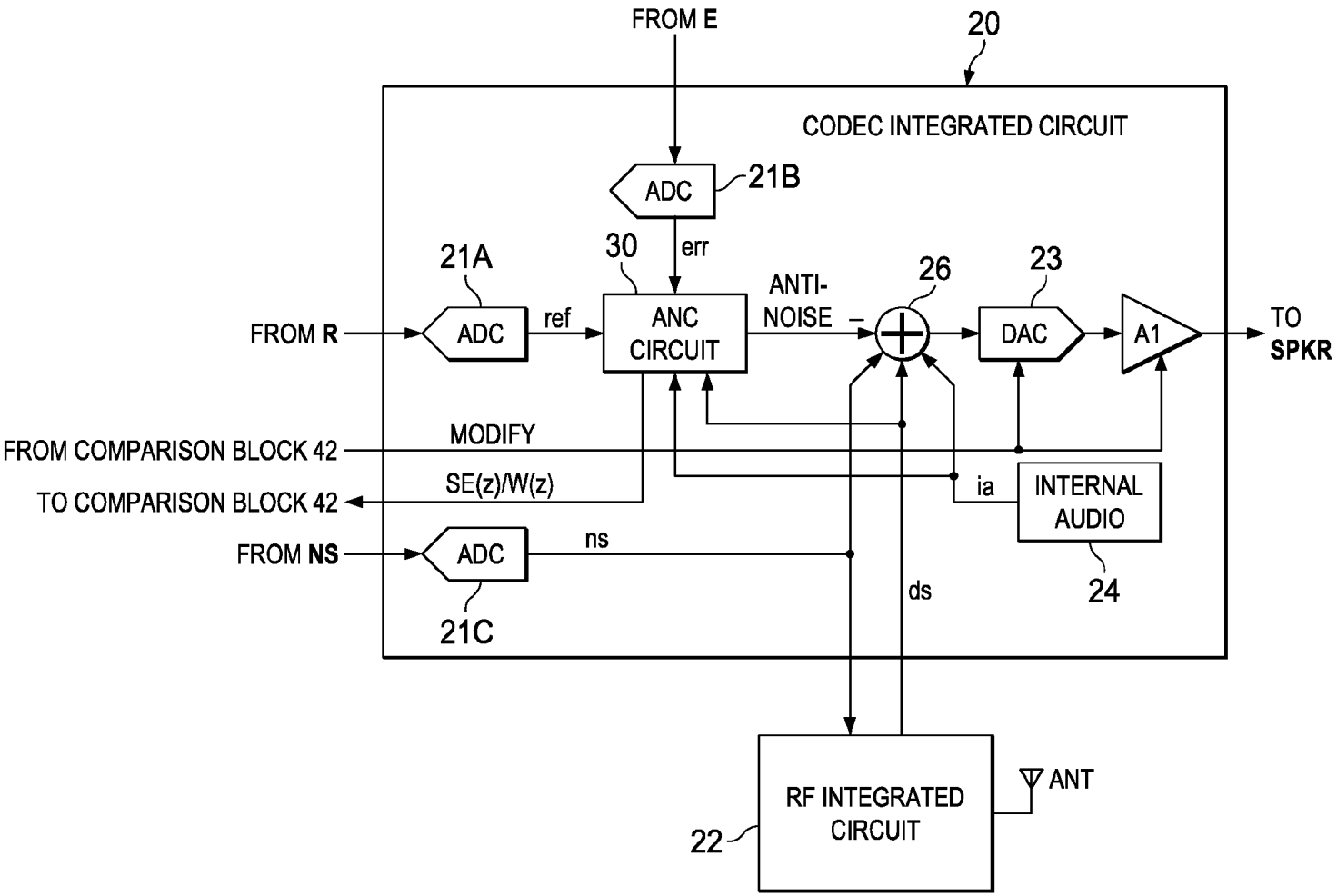
FIG. 2 is a block diagram of selected circuits within the personal audio device depicted in FIGS. 1A and 1B, in accordance with embodiments of the present disclosure.

Referring now to FIG. 2, selected circuits within personal audio device 10, which in other embodiments may be placed in whole or part in other locations such as one or more headphone assemblies 13, are shown in a block diagram. CODEC IC 20 may include an analog-to-digital converter (ADC) 21A for receiving the reference microphone signal and generating a digital representation ref of the reference microphone signal, an ADC 21B for receiving the error microphone signal and generating a digital representation err of the error microphone signal, and an ADC 21C for receiving the near speech microphone signal and generating a digital representation ns of the near speech microphone signal. CODEC IC 20 may generate an output for driving speaker SPKR from an amplifier A1, which may amplify the output of a digital-to-analog converter (DAC) 23 that receives the output of a combiner 26. Combiner 26 may combine audio signals ia from internal audio sources 24, the anti-noise signal generated by ANC circuit 30, which by convention has the same polarity as the noise in reference microphone signal ref and is therefore subtracted by combiner 26, and a portion of near speech microphone signal ns so that the listener of personal audio device 10 may hear his or her own voice in proper relation to downlink speech ds, which may be received from radio frequency (RF) integrated circuit 22 and may also be combined by combiner 26. Near speech microphone signal ns may also be provided to RF integrated circuit 22 and may be transmitted as uplink speech to the service provider via antenna ANT.

Figure 3:
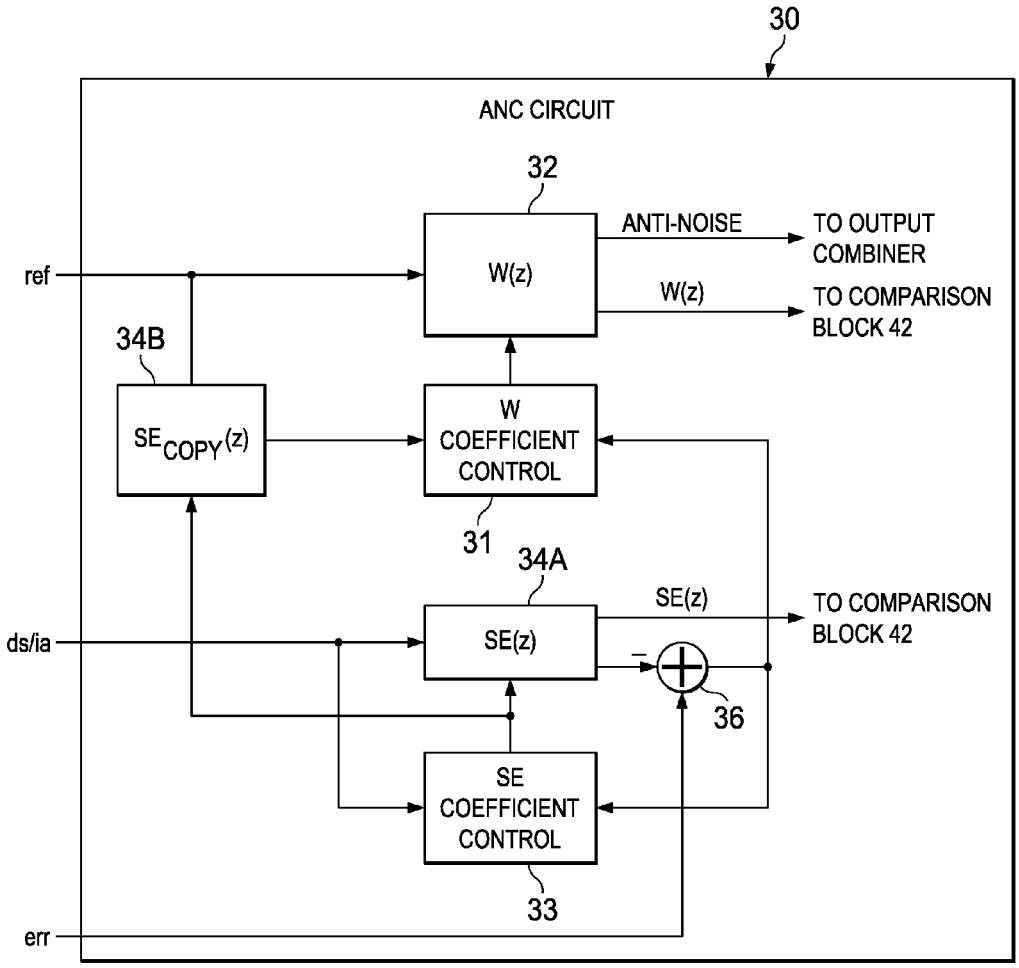
FIG. 3 is a block diagram depicting selected signal processing circuits and functional blocks within an example active noise canceling (ANC) circuit of a coder-decoder (CODEC) integrated circuit of FIG. 3, in accordance with embodiments of the present disclosure.

Referring now to FIG. 3, details of ANC circuit 30 are shown in accordance with embodiments of the present disclosure. Adaptive filter 32 may receive reference microphone signal ref and under ideal circumstances, may adapt its transfer function W(z) to be P(z)/S(z) to generate the anti-noise signal, which may be provided to an output combiner that combines the anti-noise signal with the audio to be reproduced by the transducer, as exemplified by combiner 26 of FIG. 2. The coefficients of adaptive filter 32 may be controlled by a W coefficient control block 31 that uses a correlation of signals to determine the response of adaptive filter 32, which generally minimizes the error, in a least-mean squares sense, between those components of reference microphone signal ref present in error microphone signal err. The signals compared by W coefficient control block 31 may be the reference microphone signal ref as shaped by a copy of an estimate of the response of path S(z) provided by filter 34B and another signal that includes error microphone signal err. By transforming reference microphone signal ref with a copy of the estimate of the response of path S(z), response $SE_{COPY}(z)$, and minimizing the difference between the resultant signal and error microphone signal err, adaptive filter 32 may adapt to the desired response of P(z)/S(z). In addition to error microphone signal err, the signal compared to the output of filter 34B by W coefficient control block 31 may include an inverted amount of downlink audio signal ds and/or internal audio signal ia that has been processed by filter response SE(z), of which response $SE_{COPY}(z)$ is a copy. By injecting an inverted amount of downlink audio signal ds and/or internal audio signal ia, adaptive filter 32 may be prevented from adapting to the relatively large amount of downlink audio and/or internal audio signal present in error microphone signal err and by transforming that inverted copy of downlink audio signal ds and/or internal audio signal ia with the estimate of the response of path S(z), the downlink audio and/or internal audio that is removed from error microphone signal err before comparison should match the expected version of downlink audio signal ds and/or internal audio signal ia reproduced at error microphone signal err, because the electrical and acoustical path of S(z) is the path taken by downlink audio signal ds and/or internal audio signal ia to arrive at error microphone E. As shown in FIGS. 2 and 3, W coefficient control block 31 may also reset signal from a comparison block 42, as described in greater detail below in connection with FIGS. 4 and 5.

Filter 34B may not be an adaptive filter, per se, but may have an adjustable response that is tuned to match the response of adaptive filter 34A, so that the response of filter 34B tracks the adapting of adaptive filter 34A.

To implement the above, adaptive filter 34A may have coefficients controlled by SE coefficient control block 33, which may compare downlink audio signal ds and/or internal audio signal ia and error microphone signal err after removal of the above-described filtered downlink audio signal ds and/or internal audio signal ia, that has been filtered by adaptive filter 34A to represent the expected downlink audio delivered to error microphone E, and which is removed from the output of adaptive filter 34A by a combiner 36. SE coefficient control block 33 correlates the actual downlink speech signal ds and/or internal audio signal ia with the components of downlink audio signal ds and/or internal audio signal ia that are present in error microphone signal err. Adaptive filter 34A may thereby be adapted to generate a signal from downlink audio signal ds and/or internal audio signal ia, that when subtracted from error microphone signal en, contains the content of error microphone signal err that is not due to downlink audio signal ds and/or internal audio signal ia.

For clarity of exposition, the components of audio IC circuit 20 shown in FIGS. 2 and 3 depict components associated with only one audio channel. However, in personal audio devices employing stereo audio (e.g., those with headphones) many components of audio CODEC IC 20 shown in FIGS. 2 and 3 may be duplicated, such that each of two audio channels (e.g., one for a left-side transducer and one for a right-side transducer) are independently capable of performing ANC.

Figure 4:
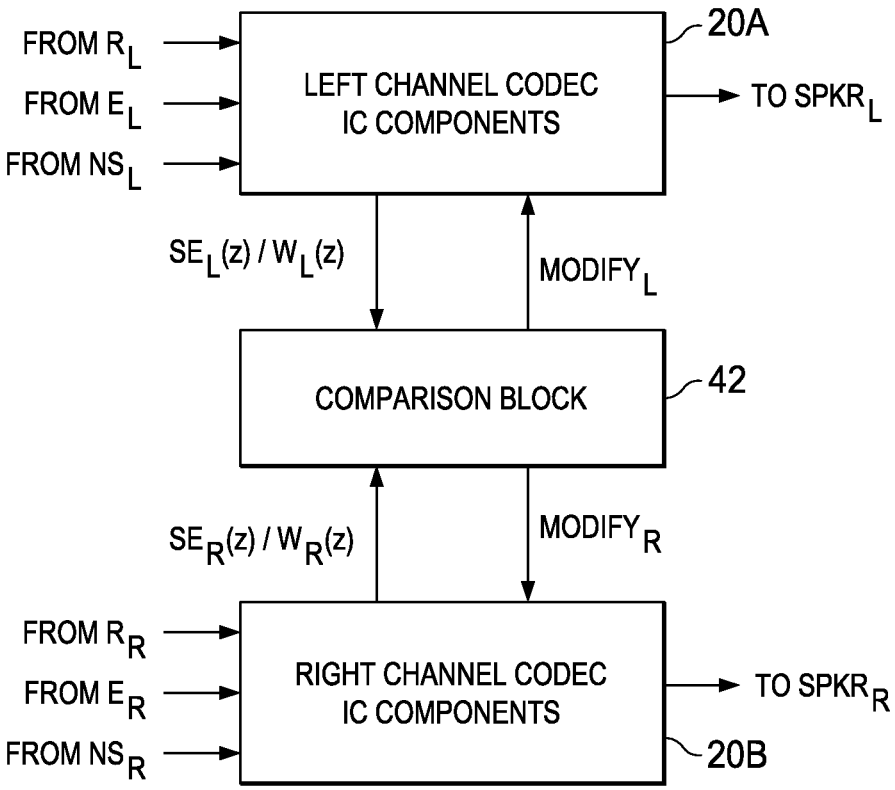
FIG. 4 is a block diagram depicting selected circuits associated with two audio channels within the personal audio device depicted in FIGS. 1A and 1B, in accordance with embodiments of the present disclosure.

Turning to FIG. 4, a system is shown including left channel CODEC IC components 20A, right channel CODEC IC components 20B, and a comparison block 42. Each of left channel CODEC IC components 20A and right channel CODEC IC components 20B may comprise some or all of the various components of CODEC IC 20 depicted in FIG. 2. Thus, based on a respective reference microphone signal (e.g., from reference microphone $R_L$ or $R_R$), a respective error microphone signal (e.g., from error microphone $E_L$ or $E_R$), a respective near-speech microphone signal (e.g., from near-speech microphone $NS_L$ or $NS_R$), and/or other signals, an ANC circuit 30 associated with a respective audio channel may generate an anti-noise signal, which may be combined with a source audio signal and communicated to a respective transducer (e.g., $SPKR_L$ or $SPKR_R$).

Comparison block 42 may be configured to receive from each of left channel CODEC IC components 20A and right channel CODEC IC components 20B a signal indicative of the response SE(z) of the secondary estimate adaptive filter 34A of the channel, shown in FIG. 4 as responses $SE_L(z)$ and $SE_R(z)$, and compare such responses. Responses of the secondary estimate adaptive filters 34A may vary based on whether a headphone 18 is engaged with an ear, and responses of the secondary estimate adaptive filters 34A may vary between ears of different users. Accordingly, comparison of the responses of the secondary estimate adaptive filters 34A may be indicative of whether headphones 18 respectively housing each of the transducers $SPKR_L$ and $SPKR_R$ are engaged to a respective ear of a listener, whether one or both of such headphones 18 are disengaged from its respective ear of the listener, or whether headphones 18 are engaged with a respective ear of two different listeners. Based on such comparison, and responsive to determining that both of the headphones 18 are not engaged with respective ears of the same listener, comparison block 42 may generate to one or both of left channel CODEC IC components 20A and right channel CODEC IC components 20B a modification signal (e.g., $MODIFY_L$, $MODIFY_R$) in order to modify at least one of the output signals provided to speakers (e.g., $SPKR_L$, $SPKR_R$) by left channel CODEC IC components 20A and right channel CODEC IC components 20B, such that at least one of the output signals is different than such signal would be if both headphones 18 were engaged with respective ears of the same listener. In some embodiments, such modification may include modifying a volume level of an output signal (e.g., by communication of a signal to DAC 23, amplifier A1, or other component of a CODEC IC 20 associated with the output signal).

Although the foregoing discussion contemplates comparison of responses SE(z) of secondary estimate adaptive filters 34A and altering a response of an audio signals in response to the comparison, it should be understood that ANC circuits 30 may compare responses of other elements of ANC circuits 30 and alter audio signals based on such comparisons alternatively or in addition to the comparisons of responses SE(z). For example, in some embodiments, comparison block 42 may be configured to receive from each of left channel CODEC IC components 20A and right channel CODEC IC components 20B a signal indicative of the response W(z) of the adaptive filter 32A of the channel, shown in FIG. 4 as responses $W_L(z)$ and $W_R(z)$, and compare such responses. Responses of the adaptive filters 32 may vary based on whether a headphone 18 is engaged with an ear, and responses of the adaptive filters 32 may vary between ears of different users. Accordingly, comparison of the responses of the adaptive filters 32 may be indicative of a whether headphones 18 respectively housing each of the transducers $SPKR_L$ and $SPKR_R$ are engaged to a respective ear of a listener, whether one or both of such headphones 18 are disengaged from its respective ear of the listener, or whether headphones 18 are engaged with a respective ear of two different listeners. Based on such comparison, and responsive to determining that both of the headphones 18 are not engaged with respective ears of the same listener, comparison block 42 may generate to one or both of left channel CODEC IC components 20A and right channel CODEC IC components 20B a modification signal (e.g., $MODIFY_L$, $MODIFY_R$) in order to modify at least one of the output signals provided to speakers (e.g., $SPKR_L$, $SPKR_R$) by left channel CODEC IC components 20A and right channel CODEC IC components 20B, such that at least one of the output signals is different than such signal would be if both headphones 18 were engaged with respective ears of the same listener. In some embodiments, such modification may include modifying a volume level of an output signal (e.g., by communication of a signal to DAC 23, amplifier A1, or other component of a CODEC IC 20 associated with the output signal). In these and other embodiments, such modification may include switching each headphone from stereo mode to a mono mode, in which the output signals to each headphone are approximately equal to each other. In these and other embodiments, such modification may include switching each headphone from stereo mode to a mono mode, in which the output signals to each headphone are approximately equal to each other.

Although the foregoing discussion contemplates detection of whether headphones 18 are engaged with respective ears of the same listener or engaged with ears of different listeners performed by responses of functional blocks of ANC systems (e.g., filters 32A or 34A), any other suitable approach may be used to perform such detection.

Figure 5:
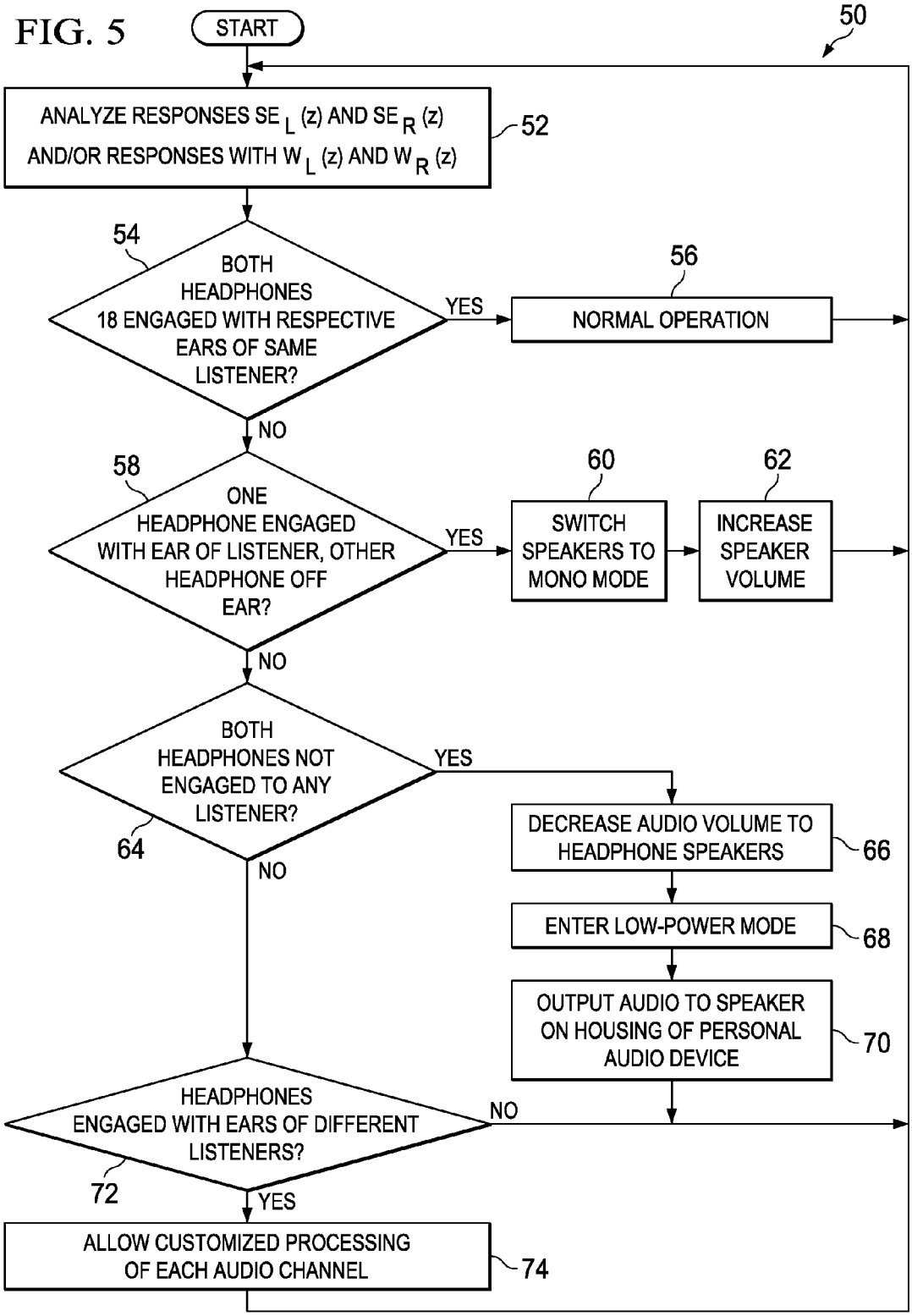
FIG. 5 is a flow chart depicting an example method for modifying audio output signals to one or more audio transducers, in accordance with embodiments of the present disclosure.

As shown in FIG. 5, responsive to a determination of whether headphones 18 are engaged with respective ears of the same listener or engaged with ears of different listeners, output signals generated by a CODEC IC 20 may be modified depending on whether both headphones 18 are disengaged from the ears of a listener, only one headphone 18 is engaged with an ear of a single listener, or headphones 18 are engaged with respective ears of two different listeners. FIG. 5 is a flow chart depicting an example method 50 for modifying audio output signals to one or more audio transducers, in accordance with embodiments of the present disclosure. As noted above, teachings of the present disclosure may be implemented in a variety of configurations of personal audio device 10 and CODEC IC 20. As such, the preferred initialization point for method 50 and the order of the steps comprising method 50 may depend on the implementation chosen.

At step 52, comparison block 42 or another component of CODEC IC 20 may analyze responses $SE_L(z)$ and $SE_R(z)$ of secondary estimate adaptive filters 34A and/or analyze responses $W_L(z)$ and $W_R(z)$ of adaptive filters 32. At step 54, comparison block 42 or another component of CODEC IC 20 may determine if the responses $SE_L(z)$ and $SE_R(z)$ and/or responses $W_L(z)$ and $W_R(z)$ indicate that both of headphones 18 are not engaged with respective ears of the same listener. If the responses $SE_L(z)$ and $SE_R(z)$ and/or if responses $W_L(z)$ and $W_R(z)$ indicate that both of headphones 18 are not engaged with respective ears of the same listener, method 50 may proceed to step 58, otherwise method 50 may proceed to step 56.

At step 56, responsive to a determination that responses $SE_L(z)$ and $SE_R(z)$ and/or that responses $W_L(z)$ and $W_R(z)$ indicate that both of headphones 18 are engaged with respective ears of the same listener, audio signals generated by each of left channel CODEC IC components 20A and right channel CODEC IC components 20B may be generated pursuant to a "normal" operation. After completion of step 56, method 50 may proceed again to step 52.

At step 58, comparison block 42 or another component of CODEC IC 20 may determine if the responses $SE_L(z)$ and $SE_R(z)$ and/or responses $W_L(z)$ and $W_R(z)$ indicate that one headphone 18 is engaged with an ear of a listener while the other headphone is not engaged with the ear of the same listener or any other listener. If the responses $SE_L(z)$ and $SE_R(z)$ and/or responses $W_L(z)$ and $W_R(z)$ indicate that one headphone 18 is engaged with an ear of a listener while the other headphone is not engaged with the ear of the same listener or any other listener, method 50 may proceed to step 60. Otherwise, method 50 may proceed to step 64.

At step 60, responsive to a determination that the responses $SE_L(z)$ and $SE_R(z)$ and/or responses $W_L(z)$ and $W_R(z)$ indicate that one headphone 18 is engaged with an ear of a listener while the other headphone 18 is not engaged with the ear of the same listener or any other listener, a CODEC IC 20 or another component of personal audio device 10 may switch output signals to speakers $SPKR_L$ and $SPKR_R$ from a stereo mode to a mono mode in which the output signals are approximately equal to each other. In some embodiments, switching to the mono mode may comprise calculating an average of a first source audio signal associated with a first output signal to one speaker SPKR and a second source audio signal associated with a second output signal to the other speaker SPKR, and causing each of the first output signal and the second output signal to be approximately equal to the average.

At step 62, also responsive to a determination that the responses $SE_L(z)$ and $SE_R(z)$ and/or responses $W_L(z)$ and $W_R(z)$ indicate that one headphone 18 is engaged with an ear of a listener while the other headphone 18 is not engaged with the ear of the same listener or any other listener, a CODEC IC 20 or another component of personal audio device 10 may increase an audio volume for one or both of speakers $SPKR_L$ and $SPKR_R$. After completion of step 62, method 50 may proceed again to step 52.

At step 64, comparison block 42 or another component of CODEC IC 20 may determine if the responses $SE_L(z)$ and $SE_R(z)$ and/or responses $W_L(z)$ and $W_R(z)$ indicate that both headphones 18 are not engaged to ears of any listener. If the responses $SE_L(z)$ and $SE_R(z)$ and/or responses $W_L(z)$ and $W_R(z)$ indicate that both headphones 18 are not engaged to ears of any listener, method 50 may proceed to step 66. Otherwise, method 50 may proceed to step 72.

At step 66, responsive to a determination that the responses $SE_L(z)$ and $SE_R(z)$ and/or responses $W_L(z)$ and $W_R(z)$ indicate that both headphones 18 are not engaged to ears of any listener, a CODEC IC 20 or another component of personal audio device 10 may increase an audio volume for one or both of speakers $SPKR_L$ and $SPKR_R$.

At step 68, also responsive to a determination that the responses $SE_L(z)$ and $SE_R(z)$ and/or responses $W_L(z)$ and $W_R(z)$ indicate that both headphones 18 are not engaged to ears of any listener, a CODEC IC 20 or another component of personal audio device 10 may cause personal audio device 10 to enter a low-power audio mode in which power consumed by CODEC IC 20 is significantly reduced compared to power consumption when personal audio device 10 is operating under normal operating conditions.

At step 70, also responsive to a determination that the responses $SE_L(z)$ and $SE_R(z)$ and/or responses $W_L(z)$ and $W_R(z)$ indicate that both headphones 18 are not engaged to ears of any listener, a CODEC IC 20 or another component of personal audio device 10 may cause personal audio device 10 to output an output signal to a third transducer device (e.g., speaker SPKR depicted in FIG. 1A), wherein such output signal is derivative of at least one of a first source audio signal associated with the first output signal and a second source audio signal associated with the second output signal. After completion of step 70, method 50 may proceed again to step 52.

At step 72, comparison block 42 or another component of CODEC IC 20 may determine if the responses $SE_L(z)$ and $SE_R(z)$ and/or responses $W_L(z)$ and $W_R(z)$ indicate that both headphones 18 are engaged to respective ears of different listeners. If the responses $SE_L(z)$ and $SE_R(z)$ and/or responses $W_L(z)$ and $W_R(z)$ indicate that both headphones 18 are engaged to respective ears of different listeners, method 50 may proceed to step 74. Otherwise, method 50 may proceed to again step 52.

At step 74, responsive to a determination that the responses $SE_L(z)$ and $SE_R(z)$ and/or responses $W_L(z)$ and $W_R(z)$ indicate that both headphones 18 are engaged to respective ears of different listeners, CODEC IC 20 or another component of personal audio device 10 may permit customized independent processing (e.g., channel equalization) for each of the two audio channels. After completion of step 62, method 50 may proceed again to step 52.

Although FIG. 5 discloses a particular number of steps to be taken with respect to method 50, method 50 may be executed with greater or fewer steps than those depicted in FIG. 5. In addition, although FIG. 5 discloses a certain order of steps to be taken with respect to method 50, the steps comprising method 50 may be completed in any suitable order.

Method 50 may be implemented using comparison block 42 or any other system operable to implement method 50. In certain embodiments, method 50 may be implemented partially or fully in software and/or firmware embodied in computer-readable media.

Figure 6:
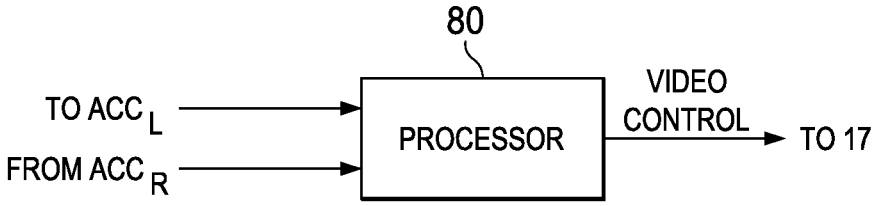
FIG. 6 is a another block diagram of selected circuits within the personal audio device depicted in FIGS. 1A and 1B, in accordance with embodiments of the present disclosure.

Referring now to FIG. 6, selected circuits within personal audio device 10 other than those shown in FIG. 2 are depicted. As shown in FIG. 6, personal audio device 10 may comprise a processor 80. In some embodiments, processor 80 may be integrated with CODEC IC 20 or one or more components thereof. In operation, processor 80 may receive orientation detection signals from each of accelerometers ACC of headphones 18 indicative of an orientation of at least one of the first headphone and the second headphone relative to the earth. When both headphones 18 are determined to be engaged with a respective ear of the same user, responsive to a change in orientation of at least one of the first headphone and the second headphone as indicated by the orientation detection signal, processor 80 may modify a video output signal comprising video image information for display to a display device of the personal audio device, for example, by rotating of an orientation of video image information displayed to the display device (e.g., between a landscape orientation and a portrait orientation, or vice versa). Accordingly, a personal audio device 10 may adjust a listener's view of video data based on an orientation of the listener's head, as determined by accelerometers ACC.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. An integrated circuit for implementing at least a portion of a personal audio device, comprising:

a first output configured to provide a first output signal to a first transducer;

a second output configured to provide a second output signal to a second transducer;

a first transducer status signal input configured to receive a first transducer status input signal indicative of whether a first headphone housing the first transducer is engaged with a first ear of a listener;

a second transducer status signal input configured to receive a second transducer status input signal indicative of whether a second headphone housing the second transducer is engaged with a second ear of the listener; and a processing circuit comprising:

a first adaptive filter associated with the first transducer;

a second adaptive filter associated with the second transducer; and a comparison block that compares the response of the first adaptive filter and the response of the second adaptive filter and determines based on the comparison whether a first headphone housing the first transducer is engaged with a first ear of a listener and the second headphone housing the second transducer is engaged with a second ear of the listener.

2. The integrated circuit of claim 1, wherein the processing circuit is further configured to modify the first output signal and the second output signal to be approximately equal to each other responsive to determining that either of the first headphone and the second headphone is not engaged with its respective ear.

3. The integrated circuit of claim 2, wherein modifying the first output signal and the second output signal to be approximately equal to each other comprises calculating an average of a first source audio signal associated with the first output signal and a second source audio signal associated with the second output signal, and causing each of the first output signal and the second output signal to be approximately equal to the average.

4. The integrated circuit of claim 1, wherein the processing circuit is further configured to modify at least one of the first output signal and the second output signal by increasing an audio volume of at least one of the first output signal and the second output signal responsive to determining that either of the first headphone and the second headphone is not engaged with its respective ear.

5. The integrated circuit of claim 1, wherein the processing circuit is further configured to modify at least one of the first output signal and the second output signal by decreasing an audio volume of at least one of the first output signal and the second output signal responsive to determining that both of the first headphone and the second headphone are not engaged with their respective ears.

6. The integrated circuit of claim 5, wherein the processing circuit is further configured to cause the personal audio device to enter a low-power mode responsive to determining that both of the first headphone and the second headphone are not engaged with their respective ears.

7. The integrated circuit of claim 1, wherein the processing circuit is further configured to modify at least one of the first output signal and the second output signal by outputting a third output signal to a third transducer device responsive to determining that both of the first headphone and the second headphone are not engaged with their respective ears, wherein the third output signal is derivative of at least one of a first source audio signal associated with the first output signal and a second source audio signal associated with the second output signal.

8. The integrated circuit of claim 1, wherein the processing circuit is further configured to modify at least one of the first output signal and the second output signal by allowing customized processing for each of the first output signal and the second output signal responsive to determining that either of the first headphone is engaged with the first ear and the second headphone is engaged with an ear of a second listener.

9. The integrated circuit of claim 1, further comprising:

an orientation detection signal input configured to receive an orientation detection signal indicative of an orientation of at least one of the first headphone and the second headphone relative to the earth; and wherein the processing circuit is further configured to modify a video output signal comprising video image information for display to a display device of the personal audio device responsive to a change in orientation of at least one of the first headphone and the second headphone as indicated by the orientation detection signal.

10. The integrated circuit of claim 9, wherein modifying the video output signal comprises rotation of an orientation of video image information displayed to the display device.

11. A method, comprising:

comparing, by a comparison block of a processing circuit, a response of a first adaptive filter associated with a first transducer housed in a first earphone and a response of a second adaptive filter associated with a second transducer housed in a second earphone; and determining, by the processing circuit, based on the comparison whether the first headphone is engaged with a first ear of a listener and the second headphone is engaged with a second ear of the listener.

12. The method of claim 11, wherein modifying at least one of the first output signal and the second output signal comprises modifying the first output signal and the second output signal to be approximately equal to each other responsive to determining that either of the first headphone and the second headphone is not engaged with its respective ear.

13. The method of claim 12, wherein modifying the first output signal and the second output signal to be approximately equal to each other comprises calculating an average of a first source audio signal associated with the first output signal and a second source audio signal associated with the second output signal, and causing each of the first output signal and the second output signal to be approximately equal to the average.

14. The method of claim 11, wherein modifying at least one of the first output signal and the second output signal comprises increasing an audio volume of at least one of the first output signal and the second output signal responsive to determining that either of the first headphone and the second headphone is not engaged with its respective ear.

15. The method of claim 11, wherein modifying at least one of the first output signal and the second output signal comprises decreasing an audio volume of at least one of the first output signal and the second output signal responsive to determining that both of the first headphone and the second headphone are not engaged with their respective ears.

16. The method of claim 15, further comprising causing the personal audio device to enter a low-power mode responsive to determining that both of the first headphone and the second headphone are not engaged with their respective ears.

17. The method of claim 11, wherein modifying at least one of the first output signal and the second output signal comprises outputting a third output signal to a third transducer device responsive to determining that both of the first headphone and the second headphone are not engaged with their respective ears, wherein the third output signal is derivative of at least one of a first source audio signal associated with the first output signal and a second source audio signal associated with the second output signal.

18. The method of claim 11, wherein modifying at least one of the first output signal and the second output signal comprises allowing customized processing for each of the first output signal and the second output signal responsive to determining that either of the first headphone is engaged with the first ear and the second headphone is engaged with an ear of a second listener.

19. The method of claim 11, further comprising:

receiving an orientation detection signal indicative of an orientation of at least one of the first headphone and the second headphone relative to the earth; and modifying a video output signal comprising video image information for display to a display device of the personal audio device responsive to a change in orientation of at least one of the first headphone and the second headphone as indicated by the orientation detection signal.

20. The method of claim 19, wherein modifying the video output signal comprises rotation of an orientation of video image information displayed to the display device.

21. The method of claim 11, further comprising, responsive to determining that at least one of the first headphone is not engaged with the first ear and the second headphone is not engaged with the second ear, modifying at least one of a first output signal to the first transducer and a second output signal to the second transducer such that at least one of the first output signal and the second output signal is different than such signal would be if the first headphone was engaged with the first ear and the second headphone was engaged with the second ear.

22. The method of claim 11, wherein:

the first adaptive filter comprises a first secondary path estimate adaptive filter for modeling an electro-acoustic path of a first source audio signal through the first transducer and having a response that generates a first secondary path estimate signal from the first source audio signal; and the second adaptive filter comprises a second secondary path estimate adaptive filter for modeling an electro-acoustic path of a second source audio signal through the second transducer and having a response that generates a second secondary path estimate signal from the second source audio signal.

23. The method of claim 22, wherein:

the first adaptive filter comprises a first feedforward adaptive filter that generates a first anti-noise signal to reduce a presence of ambient audio sounds at an acoustic output of the first transducer; and the second adaptive filter comprises a second feedforward adaptive filter that generates a second anti-noise signal to reduce a presence of ambient audio sounds at an acoustic output of the second transducer.

24. The integrated circuit of claim 1, wherein the processing circuit is further configured to, responsive to determining that at least one of first headphone is not engaged with the first ear and the second headphone is not engaged with the second ear, modify at least one of the first output signal and the second output signal such that at least one of the first output signal and the second output signal is different than such signal would be if the first headphone was engaged with the first ear and the second headphone was engaged with the second ear.

25. The integrated circuit of claim 1, wherein:

the first adaptive filter comprises a first secondary path estimate adaptive filter for modeling an electro-acoustic path of a first source audio signal through the first transducer and having a response that generates a first secondary path estimate signal from the first source audio signal; and the second adaptive filter comprises a second secondary path estimate adaptive filter for modeling an electro-acoustic path of a second source audio signal through the second transducer and having a response that generates a second secondary path estimate signal from the second source audio signal.

26. The integrated circuit of claim 25, wherein the processing circuit further comprises:

a first coefficient control block that shapes the response of the first secondary path estimate adaptive filter in conformity with the first source audio signal and a first playback corrected error by adapting the response of the first secondary path estimate filter to minimize the first playback corrected error, wherein the first playback corrected error is based on a difference between a first error microphone signal and the first secondary path estimate signal; and a second coefficient control block that shapes the response of the second secondary path estimate adaptive filter in conformity with the second source audio signal and a second playback corrected error by adapting the response of the second secondary path estimate filter to minimize the second playback corrected error, wherein the second playback corrected error is based on a difference between the second error microphone signal and the second secondary path estimate signal.

27. The integrated circuit of claim 26, wherein the processing circuit further implements comprises:

a first feedforward filter that generates a first anti-noise signal to reduce a presence of ambient audio sounds at an acoustic output of the first transducer based at least on the first playback corrected error; and a second feedforward filter that generates a second anti-noise signal to reduce a presence of ambient audio sounds at an acoustic output of the second transducer based at least on the second playback corrected error.

28. The integrated circuit of claim 1, wherein:

the first adaptive filter comprises a first feedforward adaptive filter that generates a first anti-noise signal to reduce a presence of ambient audio sounds at an acoustic output of the first transducer; and the second adaptive filter comprises a second feedforward adaptive filter that generates a second anti-noise signal to reduce a presence of ambient audio sounds at an acoustic output of the second transducer.

* * * * *